US009809941B1

(12) United States Patent
Donlin

(10) Patent No.: US 9,809,941 B1
(45) Date of Patent: Nov. 7, 2017

(54) FLARED MODULAR DRAINAGE SYSTEM WITH IMPROVED SURFACE AREA

(71) Applicant: James M. Donlin, South Windsor, CT (US)

(72) Inventor: James M. Donlin, South Windsor, CT (US)

( * ) Notice: Subject to any disclaimer, the term of this patent is extended or adjusted under 35 U.S.C. 154(b) by 0 days.

(21) Appl. No.: 14/886,492

(22) Filed: Oct. 19, 2015

Related U.S. Application Data

(60) Provisional application No. 62/065,116, filed on Oct. 17, 2014.

(51) Int. Cl.
*E02B 11/00* (2006.01)
*E03F 1/00* (2006.01)

(52) U.S. Cl.
CPC ..... *E02B 11/005* (2013.01); *E03F 1/002* (2013.01)

(58) Field of Classification Search
CPC ..... E02B 11/00; E02B 11/005; E03F 1/00; E03F 1/002; E03F 1/003; E03F 1/005; C02F 3/046; A01G 25/06
USPC ..... 405/36, 43–47, 50; 210/170.03, 170.08
See application file for complete search history.

(56) References Cited

U.S. PATENT DOCUMENTS

| | | | |
|---|---|---|---|
| 848,279 | A | 3/1907 | Ashley |
| 956,665 | A | 5/1910 | Ashley |
| 2,052,020 | A | 8/1936 | Black |
| 2,397,655 | A | 4/1946 | Francis |
| 3,478,524 | A | 11/1969 | Hoppe |
| 3,680,704 | A | 8/1972 | Schaefer |
| 4,013,559 | A | 3/1977 | Johnson |
| 4,065,925 | A | 1/1978 | Auriemma |
| 4,102,135 | A | 7/1978 | Auriemma |
| 4,183,696 | A | 1/1980 | Auriemma |
| 4,246,305 | A | 1/1981 | Delattre |
| 4,313,692 | A | 2/1982 | Johnson |
| 4,428,841 | A | 1/1984 | Favret, Jr. |

(Continued)

FOREIGN PATENT DOCUMENTS

| | | | |
|---|---|---|---|
| DE | 3815443 | A1 | 9/1988 |
| DE | 3814586 | A1 | 11/1989 |

(Continued)

OTHER PUBLICATIONS

"In-Drains," Ruck Systems, Inc., Storrs, Connecticut, 1992.

(Continued)

*Primary Examiner* — Benjamin Fiorello
*Assistant Examiner* — Stacy Warren
(74) *Attorney, Agent, or Firm* — Alix, Yale & Ristas, LLP

(57) ABSTRACT

A drainage unit has a plurality of modules defining channels with arced or flared surfaces longitudinally spaced from one another for installation into a ground excavation. The spaced modules may be aligned on a longitudinally support pipe that may provide a fluid connection between the channels. The adjacent surfaces of successive modules are spaced from each other a non-constant distance across the laterally transverse thickness or height. Filtration fabric that allows fluid flow therethrough while substantially filtering surrounding soil or other back fill is wrapped around each of modules. The flared and/or arced configuration of the modules defining channels allows for increased surface area interfacing between the channels and soil and a corresponding reduction in laterally transverse footprint.

20 Claims, 9 Drawing Sheets

(56) References Cited

U.S. PATENT DOCUMENTS

| | | | |
|---|---|---|---|
| 4,662,778 | A | 5/1987 | Dempsey |
| 4,730,953 | A | 3/1988 | Tarko |
| 4,824,287 | A | 4/1989 | Tracy |
| 4,880,333 | A | 11/1989 | Glasser et al. |
| 4,904,112 | A | 2/1990 | McDonald |
| 4,904,113 | A | 2/1990 | Goddard et al. |
| 4,917,536 | A | 4/1990 | Glasser |
| 4,948,295 | A | 8/1990 | Pramsoler |
| 5,017,040 | A | 5/1991 | Mott |
| 5,017,042 | A | 5/1991 | Minor et al. |
| 5,129,758 | A | 7/1992 | Lindstrom |
| 5,263,792 | A | 11/1993 | Davis et al. |
| 5,378,357 | A | 1/1995 | Houck et al. |
| 5,597,264 | A | 1/1997 | Laak |
| 5,639,364 | A | 6/1997 | Houck et al. |
| 5,752,784 | A | 5/1998 | Motz et al. |
| 5,887,625 | A | 3/1999 | Takahashi |
| 5,951,203 | A | 9/1999 | Laak |
| 5,989,416 | A | 11/1999 | Gorton |
| 5,997,735 | A | 12/1999 | Gorton |
| 6,048,131 | A | 4/2000 | Laak |
| 6,270,661 | B1 | 8/2001 | Jowett |
| 6,280,117 | B1 | 8/2001 | Obermeyer et al. |
| 6,485,647 | B1 | 11/2002 | Potts |
| 6,531,063 | B1 | 3/2003 | Rose |
| 6,659,687 | B1 | 12/2003 | Donlin et al. |
| 6,726,401 | B1 | 4/2004 | Potts |
| 6,869,533 | B2 | 3/2005 | Norgaard |
| 6,887,383 | B2 | 5/2005 | Potts |
| 6,923,905 | B2 | 8/2005 | Potts |
| 7,465,390 | B2 | 12/2008 | Potts |
| 7,614,822 | B1 | 11/2009 | Burritt et al. |
| 8,104,994 | B1 * | 1/2012 | Donlin ..... E02B 11/005 405/36 |
| 2002/0044833 | A1 | 4/2002 | Kruger et al. |
| 2006/0182497 | A1 | 8/2006 | Potts |
| 2006/0272988 | A1 | 12/2006 | Potts |
| 2007/0292210 | A1 * | 12/2007 | Currivan ..... E03F 11/00 405/43 |
| 2008/0202999 | A1 | 8/2008 | Potts |
| 2008/0203002 | A1 | 8/2008 | Potts |
| 2009/0014380 | A1 * | 1/2009 | Houck ..... E03F 1/002 210/417 |
| 2009/0269137 | A1 | 10/2009 | Bussey, Jr. et al. |
| 2011/0062069 | A1 * | 3/2011 | Couch ..... C02F 1/006 210/170.08 |

FOREIGN PATENT DOCUMENTS

| | | | | |
|---|---|---|---|---|
| JP | 56156313 | A | 3/1981 | |
| JP | 60059218 | A | 4/1985 | |
| SU | 1772313 | A1 | 10/1992 | |
| WO | WO 03046295 | A2 * | 6/2003 | ..... E03F 1/002 |

OTHER PUBLICATIONS

Laak, R., "Using In-Drains at Soil Clogging Infiltration Surface," Univ. of Connecticut, 1988 International Summer Meeting of the American Society of Agricultural Engineers, Jun. 26-29, 1988.

Laak, R., "Using In-Drain Geosynthetics in Soil Infiltration Systems," Univ. of Connecticut, 1989 International Summer Meeting of the American Society of Agricultural Engineers and the Canadian Society of Agricultural Engineering, Jun. 25-28, 1989.

* cited by examiner

Figure 5
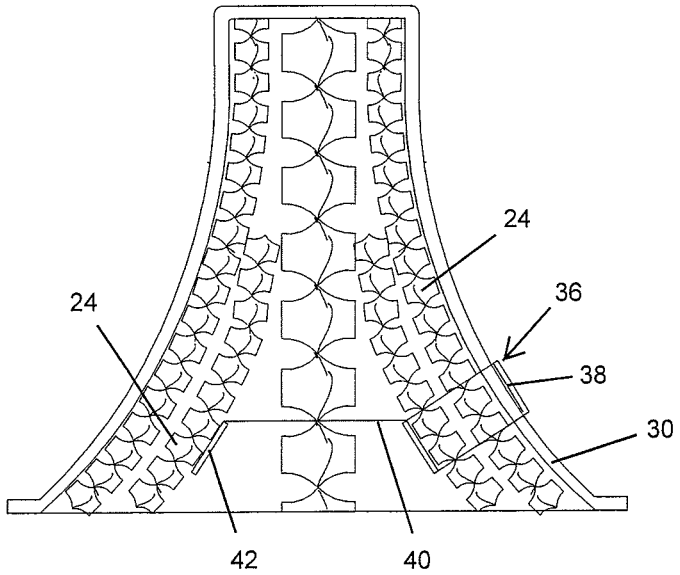
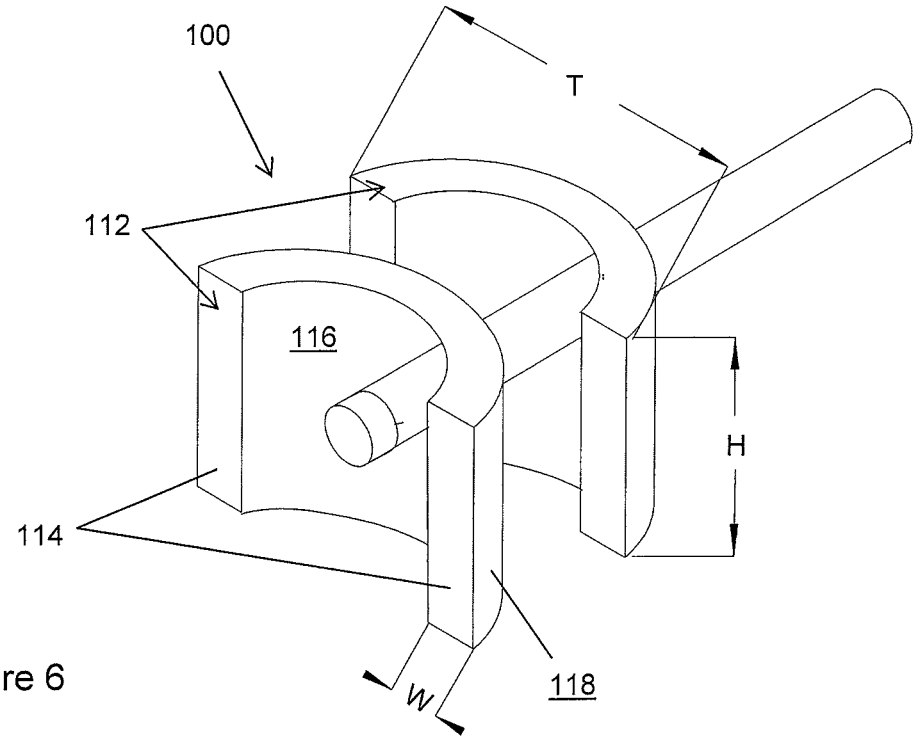
Figure 6

FLARED MODULAR DRAINAGE SYSTEM WITH IMPROVED SURFACE AREA

CROSS-REFERENCE TO RELATED APPLICATION

This application claims priority from U.S. Provisional Application No. 62/065,116 filed Oct. 17, 2014, the entire content of which is hereby incorporated by reference.

BACKGROUND

The present disclosure relates generally to the field of subsoil fluid absorption and drainage systems, and more particularly to a unit and system which includes a plurality of modules with an outwardly flared or arced contour, improving physical stability and surface area while decreasing overall environmental footprint.

Conventional subsoil fluid absorption systems comprise trenches or excavations filled with small rock aggregate and overlaid with a perforated pipe. The pipe may be overlaid with a geotextile fabric and/or more rock aggregate. Soil is placed over the aggregate and perforated pipe to fill the trench to the adjoining ground level. In use, fluid flows through the pipe and out the perforations. Fluid is held within cavities in the aggregate until it can be absorbed into the soil. Other conventional systems use hollow plastic chambers placed beneath ground level to hold fluid until the fluid can flow through slits or apertures in the chamber and can be absorbed into the soil.

Current subsoil based absorption system products are limited in their design configuration, lack system flexibility and installation adaptability. For example, vertical separation may require additional fill in order to maintain adequate separation to groundwater or restrictive layers. It is also difficult for conventional systems to provide the increased bottom area and/or sidewall area required in some designs. Engineers, absorption system designers and absorption system installers are often faced with the dilemma of making the currently available products work in an unsuitable environment. Installation of the rock aggregate also entails moving tons of aggregate from a pile and evenly distributing the aggregate into the excavation. Such movement is time consuming, requires specialized equipment and tends to destroy large parts of the surrounding lawn areas, and is thus very costly. Further, many known systems require significant disruption of the ground environment due to the size and scope of the excavation required to accommodate a drainage system that has certain prescribed drainage interface surface area characteristics that may be desired or required by government regulation.

There is thus a need for an effective, easily installed drainage system with an improved surface area of interface with the external environment without increasing longitudinal or transverse length, and/or a system with similar or increased surface area characteristics and a reduced transverse or longitudinal length.

SUMMARY

An embodiment of the disclosed drainage unit for installation in a ground excavation has a first conduit and a second conduit. The first and second conduits each extend in an arcuate shape between opposing transverse edges. The first conduit is longitudinally spaced from the second conduit. The first conduit includes a front face that extends between a top and bottom edge and is arced in a first longitudinal direction, and a rear face that extends between a top and bottom edge substantially the same distance as the front face. The second conduit has a front face longitudinally spaced from the first conduit rear face defining a filtration surface, and a second conduit rear face. The second conduit rear face and the second conduit front face extend from respective top to bottom edges. The first conduit and second conduit are fluidly connected above their respective bottom edges. The first channel spans an arcuate shape between its opposing transverse edges of between approximately 60-270°. The second channel spans an arc between its opposing transverse edges of between approximately 60-270°. The spacing between the first channel rear face and second channel front face is not constant across a line substantially perpendicular to the longitudinal direction.

Embodiments of the disclosed drainage unit allow an increase in surface area of drainage channels that interface with the external environment, while decreasing or maintaining constant the transverse thickness of the system, thereby decreasing the overall environmental footprint.

BRIEF DESCRIPTION OF THE DRAWINGS

Aspects of the preferred embodiment will be described in reference to the Drawings, where like numerals reflect like elements:

FIG. 5 is a section view of another embodiment of a flared module for use in the disclosed system;

FIG. 6 is a perspective view of an embodiment of a drainage system with longitudinally arced channels;

DETAILED DESCRIPTION

Figure 1:
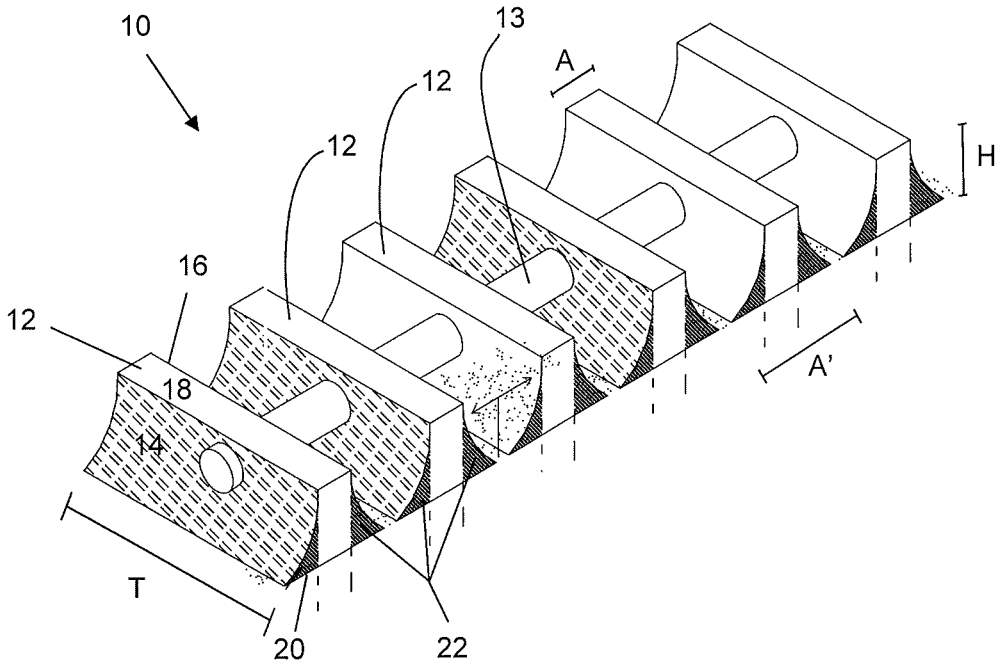
FIG. 1 is a perspective view of an embodiment of the disclosed modular system with longitudinally flared drainage modules.
Figure 2:
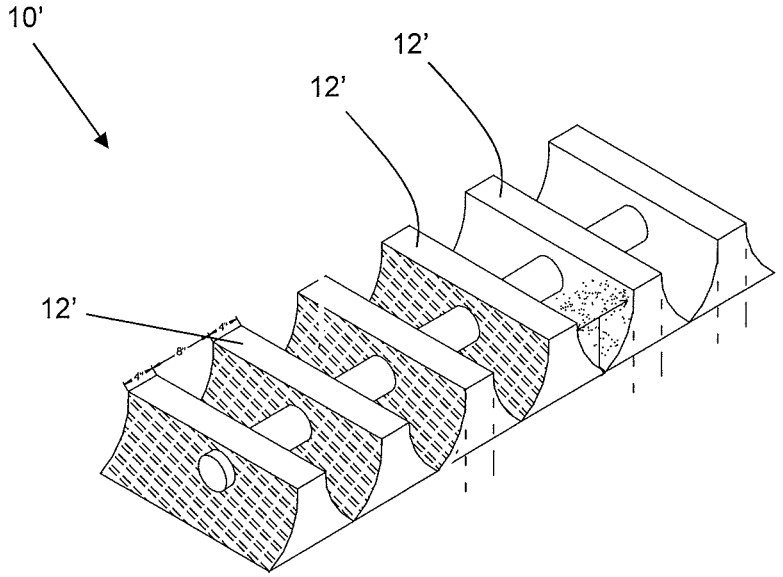
FIG. 2 is a perspective view of an alternate embodiment of the modular system with longitudinally flared drainage modules.

As shown with reference to FIGS. 1 and 2, an embodiment of the disclosed modular subsoil drainage system includes a plurality of modules with front and rear faces that flare outward toward the respective lower ends. The modules are positioned arranged in a spaced orientation along a support pipe in a configuration allowing the channels defined by the modules to receive drainage fluid such as wastewater.

FIG. 1 depicts an embodiment of the unit 10 wherein each module 12 is spaced from adjacent modules along all edges and surfaces. FIG. 2 depicts an embodiment wherein the lower edges of adjacent flared modules 12' abut each other, while the remainder of the respective modules are spaced from each other along the support pipe due to the flared configuration.

Each flared module 12 and 12' may be constructed of a suitable sheet material. Preferably the sheet material is a polymeric core material. Recycled high impact polystyrene having a thickness of 0.24 inches has been found suitable for use as a module sheet. The module sheets are configured into flat sheets and/or egg carton shaped cuspated core sheets, which may or may not include holes therein. Cuspated sheets are described in U.S. Pat. No. 4,880,333 the contents of which are incorporated by reference and have utilized in other drainage systems. Similar sheets may be employed in the other disclosed embodiments of the drainage unit, as will be discussed in detail below. The cuspated core sheets, alone or in combination with flat sheets are aligned in face to face orientation to form a support module 12 or 12'. In embodiments comprising numerous upright polymer sheets in face-to-face orientation, the individual sheets may vary in original height dimension to account for the concave flared front face and rear face contour. For example, the opposite outermost sheets have the largest original (flat) height and successive sheets may decrease in original height as they move inward within the individual module. Alternate embodiments may include opposite sheets of one original height dimension, and numerous identical sheets on the interior of the module with no sheet material positioned in the interior of the flared portion of the module (i.e., the shaded portions of FIG. 1). As will be described further below, other filler material may be employed within the channel to provide internal structure, such as random polystyrene packing (for example, Styrofoam "peanuts"). Additionally, embodiments exist wherein only the outer shell of each module comprises polymer sheet material and the interior is filled with another material.

The support pipe 13 is typically a polymeric material, for example polyethylene (PE), polyvinyl chloride (PVC) or acrylonitrile-butadiene-styrene copolymer (ABS), although other materials compatible with the anticipated use may also be used. One preferred support pipe is ADS 3000© triple wall pipe available from Advanced Drainage Systems, Inc. of Hilliard, Ohio. The ADS 3000© pipe has increased stiffness and crush strength compared to other polymer pipes. The support pipe 13 can be solid or define one or more perforations, along some or all of its length. The perforations may align with the position of the support module 12 on the support pipe 13 to define a fluid path through the pipe 13 to the channel defined by the support module 12. The perforations and module spacing can be designed to allow fluid flow to any or all of the modules.

Figure 4:
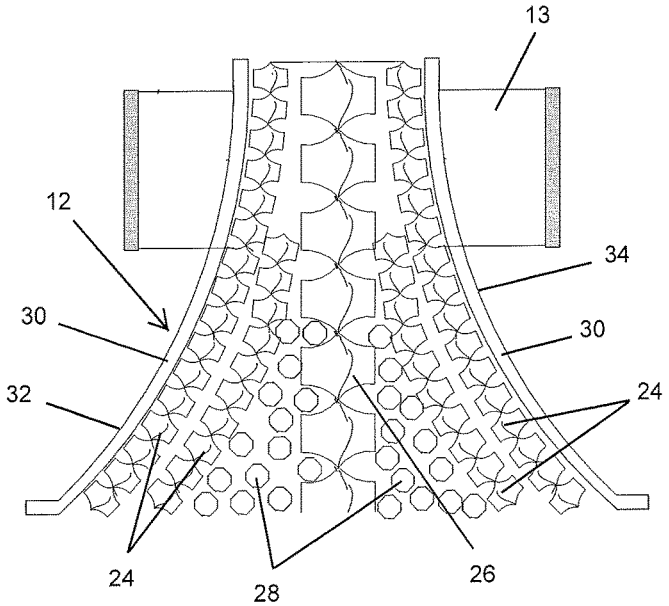
FIG. 4 is a partial section view of an embodiment of a module used in the systems of FIGS. 1 and 2.

With reference to FIG. 4, depicted in partial cross section is a longitudinally flared module for use in the disclosed system, like that shown in FIG. 1-2 as 12 or 12'. This embodiment includes a plurality of corrugated polymer core sheets 24 and 26 with random polystyrene packing 28 and outer filtration fabric layers 30, with a longitudinal pipe 13 extending through an opening in the module 12. The outer layers of polymer core 24 are flared in opposite longitudinal directions, giving the module and channel its flared structure. In this embodiment, the polystyrene fill 28 is packed on the interior of the channel to provide resistance on the bowed outer polymer sheets 24 in order to maintain the desired flared structure. One or more central support core sheets 26, having a lateral thickness T equal to that of the outer polymer sheets 24, may also be positioned longitudinally intermediate the bowed outer polymer sheets 24 extending substantially laterally, primarily for added support of the module. Also as shown, one or more filtration sheets 30 are positioned to the outside of the outer polymer sheets 24, thereby defining a longitudinally flared front surface 32 and a rear surface 34 flared in the opposite longitudinal direction. The filtration sheets may preferably be made from a geotextile fabric that allows a flow of fluid to permeate therethrough while at least partially resisting infiltration by sand, soil or other particulates. The flared configuration substantially increases surface area of the modules or channels 12, 12' that interfaces with the surrounding environment (typically soil or other back fill) via both the front and rear faces 32 and 34, and substantially increases the area of the bottom footprint of each module without adding to the overall longitudinal or laterally transverse footprint of the drainage unit itself. The increased surface area of each channel interfacing with the external environment substantially increases the overall volume and drainage rate of fluid effluent that the drainage unit can treat and accommodate.

Figure 3:
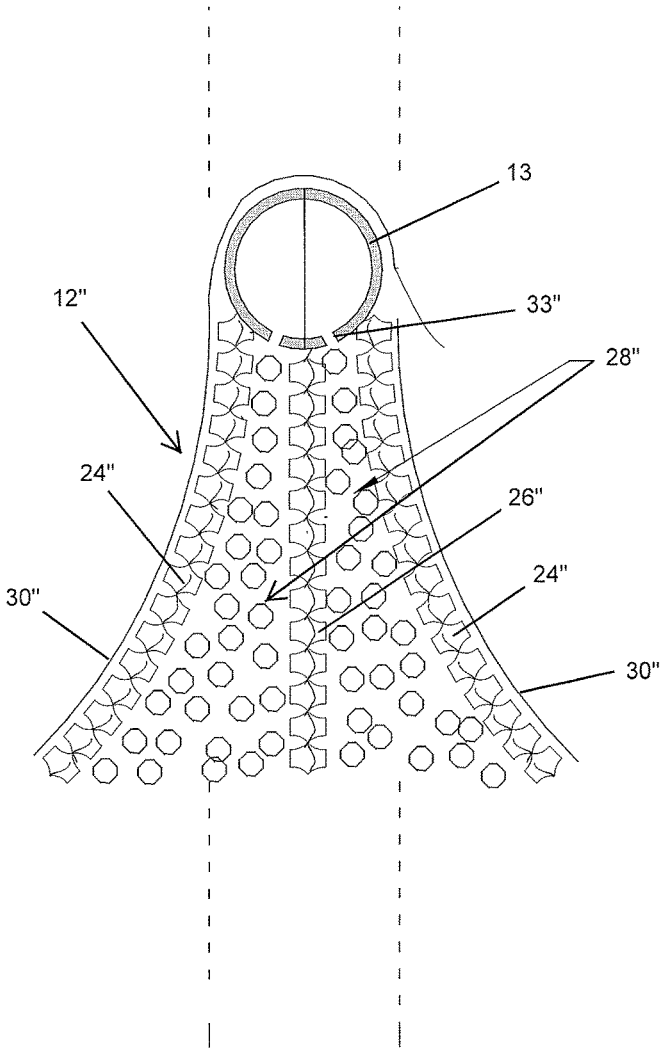
FIG. 3 is a section view of an embodiment of the disclosed system with modules flared in the lateral direction.

The relative alignment of the longitudinal support pipe 13 and modules is not limited to a longitudinally flared configuration, like that shown in FIGS. 1, 2 and 4. As shown in FIG. 3, a similar module 12" may be configured with lower outward flares in the laterally transverse direction relative to the longitudinally extending support pipe or conduit 13. As depicted, this embodiment similarly includes a plurality of outer cuspated core sheets 24', a central cuspated core sheet 26' with random polystyrene packing 28' to provide the inner structure for the flared outer surfaces. A similar increase in area of the channel surfaces interfacing with the surrounding environment is achieved with the laterally flared modules, also without sacrificing lateral or longitudinal footprint of the drainage unit or system as a whole. While not depicted in FIG. 4, FIG. 3 shows a support pipe 13 with one or more openings 33' longitudinally aligned with the module 12' for distribution of fluid to the channel. Other embodiments exist with one or more fluid distribution conduits positioned above the top surfaces of the modular units 10 or 10', typically a pipe extending in the longitudinal direction with openings aligned with the top surface of one or more modules.

FIG. 5 depicts another representative flared module for use in the disclosed system. In this embodiment, a support member 36 is utilized for providing or at least improving the stability of the flared configuration. Here, the support member 36 includes a bracket element 38 on one end with an extension bar 40 extending therefrom to an opposite flange 42. The bracket 38 may be wrapped laterally around the front or rear outer flared polymer sheet or sheets 24 with the extension bar 40 extending longitudinally through the channel. The opposite flange abuts the inner surface of the opposite outer flared polymer sheet 24, thereby providing the requisite mechanical resistance to maintain the desired flared configuration of module. The extension bar 40 may vary in longitudinal length as desired for modules of varying thickness and/or to achieve a particular flared contour or angle. Another embodiment includes an extension member that can reciprocate longitudinally to adjust the flared contour.

Additional characteristics of the flared modular system are identified below:

Separate individual modules

Each module has front face 14 and rear face 16 which extend and transition between an upper face 18 with surface area A, and a lower face 20 with surface area A' that is greater than A.

Surface area A' is typically between 25% and 300% greater than surface area A (see for example Table 1 below).

Shaded areas 22 in FIG. 1 represent the increase in lower face longitudinal thickness compared to the upper face, resulting in substantially increased surface area on the bottom face and thus improved absorption properties of the entire system as well as additional surface area credit from regulatory authorities.

Preferably, the upper and lower faces (18, 20) lie substantially parallel to each other, though this is a non-limiting characteristic.

Front and rear faces (14, 16) transition from upper face edge in a generally concave arc, producing the "flared" contour toward at the bottom of the modules.

Fluid permeable geotextile filtration fabric substantially encases each module, defining an inner cavity suitable for receipt of drainage fluid.

The inner cavity of the modules can be upright polymer sheets, which may be cuspated and/or may have holes therein; or may include another support fill such as, for example, loose Styrofoam®, inert mesh, shredded polymer, or similar.

The respective modules (12, 12') are spaced along a support pipe 13 (described above).

The support pipe 13 may have holes and may be used for fluid distribution to the modules or fluid may be delivered to the system via another distribution conduit, for example, a pipe positioned above the upper faces of the modules.

In all depicted embodiments, the front and rear edges of successive upper faces 18 are spaced from each other. This allows backfill to be delivered to the excavation between each module.

Front and rear edges of lower faces may be spaced from each other (see FIG. 1) or may abut (see FIG. 2), thereby providing an uninterrupted fluid permeable bottom face of modular unit.

Sand, aggregate, stone or similar backfill material is filled around the system and in the spacing between each module.

Examples of flared modular units like those depicted as reference numerals 12 and 12' are shown in Table 1 below, indicating the substantial increase in surface area achieved by the inventive flared configuration:

TABLE 1

| Example | Module lateral width - W (inches) | Upper face longitudinal thickness - $T_u$ (inches) | Upper face surface area - A (inches$^2$) | Lower face longitudinal thickness -$T_l$ (inches) | Lower face surface area - A' (inches$^2$) | increase in lower:upper face surface area (%) | Increase in total surface area lower:upper for 6 module system (inches$^2$) |
|---|---|---|---|---|---|---|---|
| 1 | 24 | 3 | 72 | 5 | 120 | 67 | 288 |
| 2 | 24 | 3 | 72 | 6 | 144 | 100 | 432 |
| 3 | 24 | 3 | 72 | 7 | 168 | 133 | 288 |
| 4 | 24 | 4 | 96 | 6 | 144 | 50 | 288 |
| 5 | 24 | 4 | 96 | 8 | 192 | 100 | 576 |
| 6 | 24 | 4 | 96 | 10 | 240 | 150 | 864 |
| 7 | 24 | 4 | 96 | 12 | 288 | 200 | 1152 |

FIG. 6 shows an embodiment of a drainage unit 100 utilizing a plurality of arced channels 112 spaced from one another. The exemplified embodiment again includes a support pipe 113 extending through each module 112 that defines the arched channels, with successive modules 112 space from each other in the excavation (here, spaced along the pipe 113). Each module has a lateral thickness T, a height H and a width W. Typically the contour of the arced shape circumferentially spans an angle of between approximately 60° and approximately 270°. As shown, the front surface includes a pair of opposite front edge surfaces 114, each with a width W, laterally spaced from each other by an inner arced surface 116. The front edge surfaces 114 extend between the front arced surface 116 and a rear arced surface 118. The lower edges of the front edge surfaces 114, front arced surfaces 116 and rear arced surface 118 define a lower footprint of the channel 112, which may contact a bottom surface of an excavation E when the drainage system is installed. Similar to other embodiments, the drainage unit 100 may include a support pipe 113 with apertures to allow for fluid distribution (not shown). The apertures may advantageously align longitudinally between the front arced surface 116 and rear arced surface 118 of at least one module 112 to provide fluid flow to the inner channel. FIG. 6 depicts a drainage unit 100 with two spaced modules 112 having substantially similar characteristics and dimensions, however any number of spaced modules may make up the drainage system, and the modules need not be of the same dimensions. As with all embodiments disclosed herein, a plurality of drainage units 100 may be installed in an excavation, optionally connected to each other, to make up a drainage system.

Figure 7:
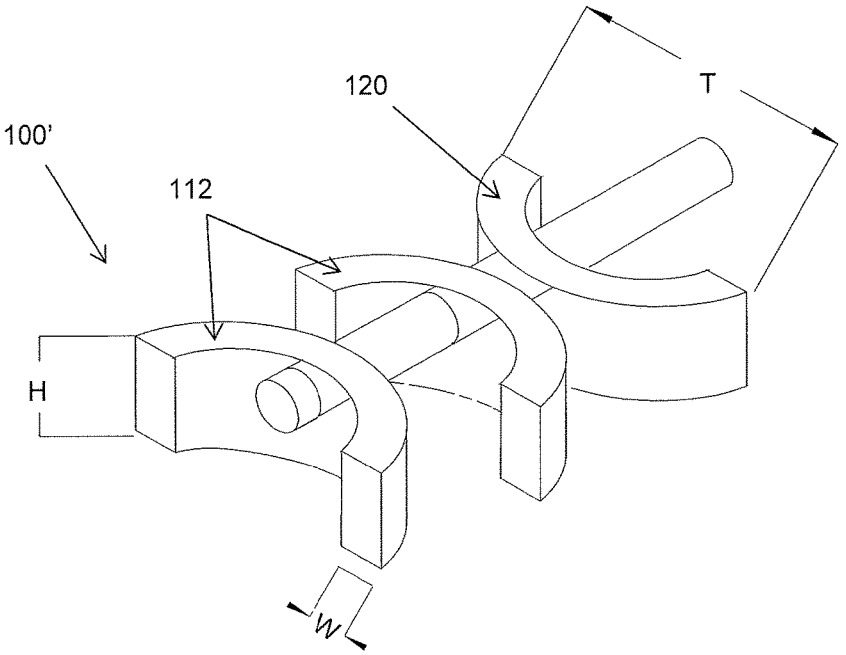
FIG. 7 is a perspective view of another embodiment of a drainage system with longitudinally arced channels.

FIG. 7 shows another exemplary drainage unit 100' with spaced arced channels 112. This unit includes a rear module 120 spaced from another module 112 being arced in the opposite longitudinal direction; that is the module 120 is positioned arcing in a longitudinally rearward direction, while the module 112 is positioned arcing in the longitudinally frontward direction with their apexes facing each other.

Figure 8:
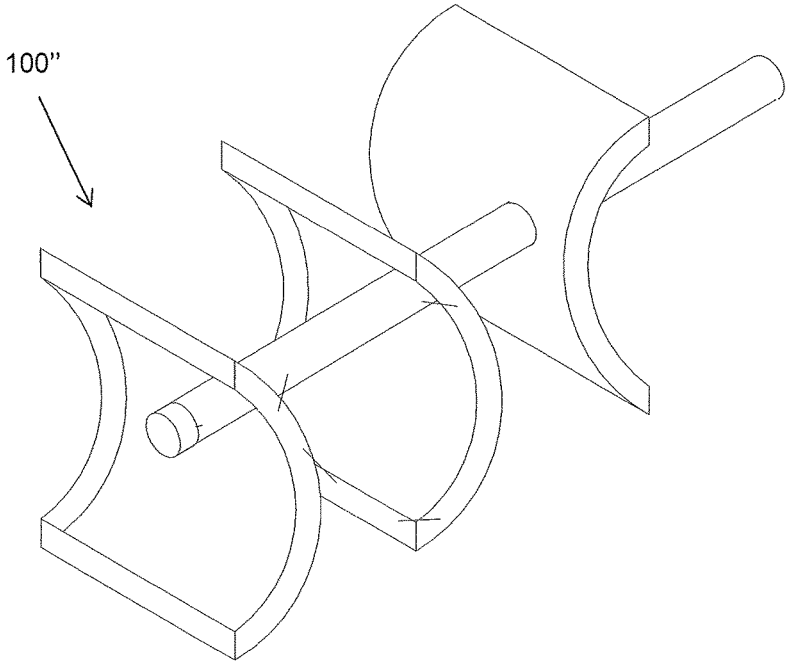
FIG. 8 is a perspective view of yet another embodiment of a drainage system with arced channels.

FIG. 8 shows an embodiment of a drainage system 100" with arced modules wherein the modules are arced longitudinally forward in the upward and downward direction rather than the laterally transverse direction, like those in FIGS. 6 and 7.

Figure 9:
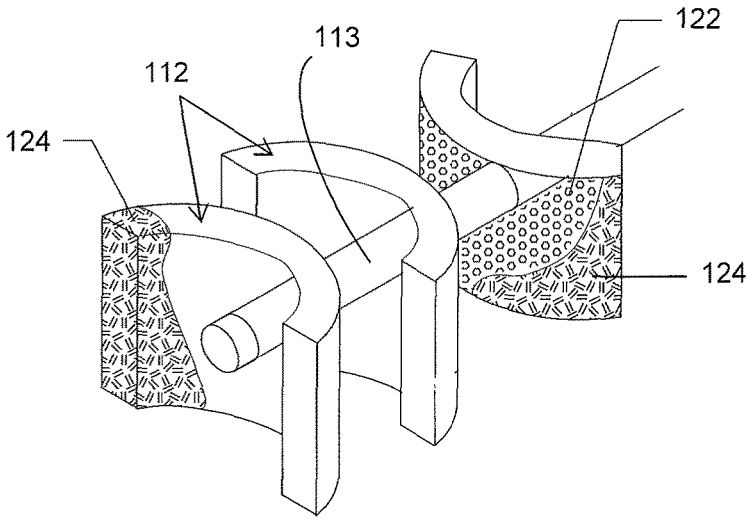
FIG. 9 shows an embodiment of the disclosed system with arced channels in partial skeletal view.

With reference to FIG. 9, the exemplary arced modules, like those depicted in the prior Figures may comprise at least one polymeric core sheet 122 wrapped in a filtration material 124, such as a geotextile fabric, which substantially defines the module or channel outer surface. Preferably, the interior portion of the module 112 comprises at least two cuspated core sheets 122 with substantially the same height H aligned with each other to make up a substantially rigid body structure. Outer lateral edges of the core sheets 122 may thereafter be biased inward to yield the desired arced configuration. The inward biasing at the opposite edges resulting in the arced channel consequently reduces the transverse thickness of each module, and therefore the entire resulting drainage unit 100, while maintaining an equal lower footprint area of each channel. Preferably, the core sheets 122 are wrapped with the filtration geotextile fabric 124 after being formed into the preferred arc shape so that the fabric 124 tightly adapts to the outer contour of the arc without significant bunching. The filtration fabric layer may be wrapped around all sides and surfaces of the modules or only certain sides, depending on the desired configuration. Embodiments also exist with additional filtration sheets within the channels themselves aligned with the core sheets.

As noted above, embodiments of the arced drainage unit 100 comprise arced modules of varying characteristics. All embodiments of the disclosed drainage units have been shown to be effective for distributing effluent to an external environment, such as soil or other backfill, while substantially reducing the overall footprint of the excavation required to accommodate the drainage units. The reduction in overall excavation footprint is accomplished via the arced contour that reduces the lateral thickness T of each module relative to a rectangular or other transversely straight module having the same lower footprint area.

For example, a module comprising core sheets having dimensions of 36 inches long by 18 inches high, and having a width W of 4 inches has a lower footprint area of 144 square inches interfacing the lower surface of the excavation, and a rear surface footprint of 648 square inches. A module comprising core sheets with the same dimensions, and having the same width W formed into an arc circumferentially spanning approximately 180° has equal lower footprint and rear face areas, but a transverse thickness T of only 23 inches. Consequently, the transverse thickness of the representative drainage unit that employs 180° arced modules is reduced by approximately 36% relative to the flat modular unit, while maintaining the same area of the lower footprint and front and rear surface interfacing with the excavation. Embodiments of the drainage unit exist that reduce the transverse thickness relative to a planar module having substantially the same lower footprint by between 10-70%, and more preferably between about 20-50%. Moreover, the varying longitudinal distance between successive spaced surfaces (and thus the shape of backfill) has been shown to be particularly effective at accommodating significant volumes of drainage fluid.

Embodiments of the arced modules exist spanning circumferential angles within the range of between 60° and 270°, with especially preferred embodiments within the range of 120. Exemplary arced units have a width W within an approximate range of 2-24 inches; a height H within an approximate range of 6-36 inches; and a transverse thickness T within an approximate range of 12-64 inches. The circumferential distance of the rear faces of the modules typically varies from approximately 12-160 inches. The modules 100 according to the herein disclosure may be spaced from each other in the excavation by 1.5 inches or more, and more preferably by approximately 3-12 inches at the position with the spaced surfaces being the closest to one another. For example, the depicted embodiment of the drainage unit 100 in FIG. 6 includes modules having an approximate height H of 18 inches, width W of 4 inches and a transverse thickness T of 36 inches. The embodiment of the drainage unit 100' depicted in FIG. 7 is configured for use in a shallower excavation with a height H of approximately 12 inches, width W of 4 inches and transverse thickness T of 36 inches.

Figure 10:
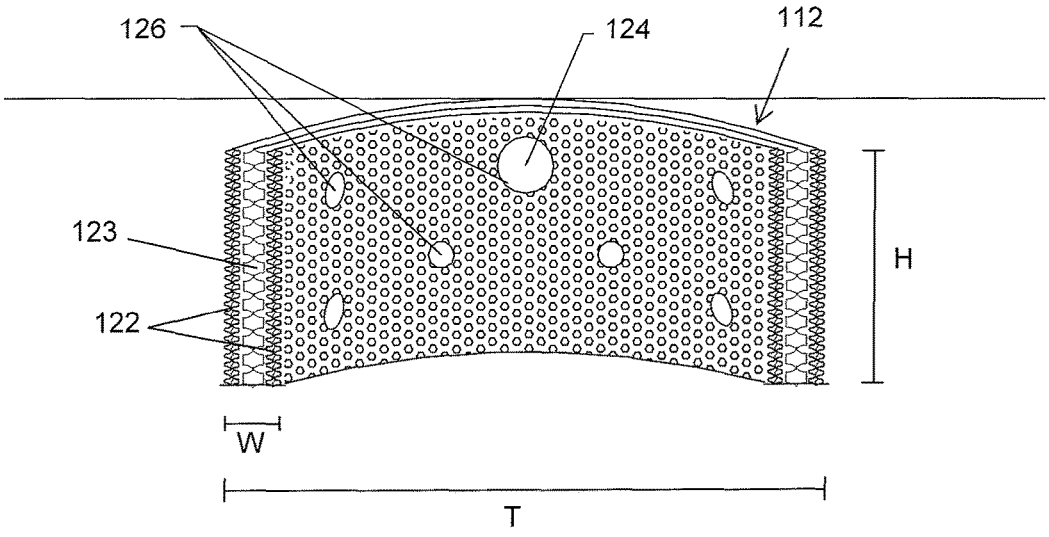
FIG. 10 shows a representative embodiment of an arced channel in skeletal view.
Figure 11:
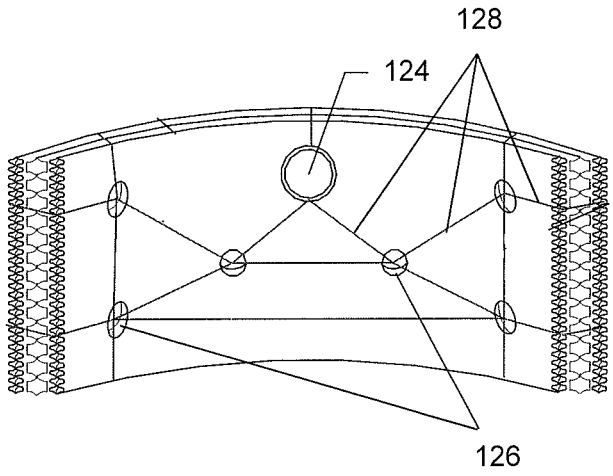
FIG. 11 shows the arced channel of FIG. 10 with representative adjustment ties.

FIG. 10 is a skeletal depiction of a representative arced module 112 for use in the disclosed drainage system (with filtration fabric removed from the drawing for clarity). This module 112 includes two outer core sheets 122 separated by an intermediate support core sheet 123. A pipe aperture 124 and a plurality of tie apertures 126 extend through the module 112 from the front face to the rear face. As depicted in FIG. 11, numerous straps or ties 128 may be employed for forming the module into the desired arced configuration, as well as to assist in maintaining an outer fabric layer tightly against the core sheets 122.

Figure 12:
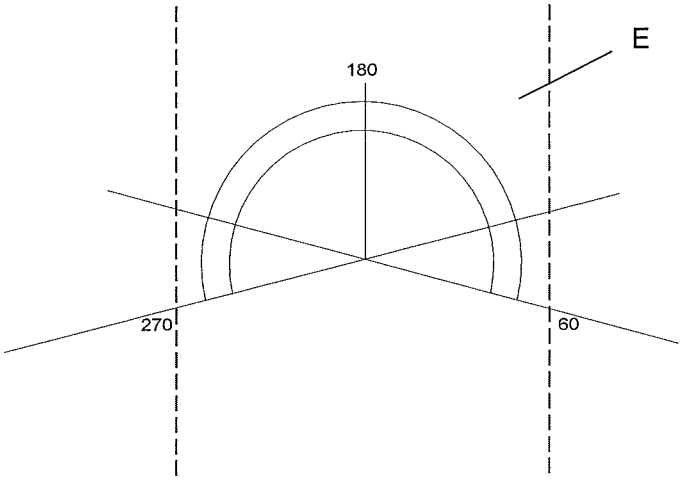
FIG. 12 is a top plan view of an arced channel in an excavation.

FIG. 12 shows a top plan view of an exemplary arced module 112 in a longitudinally extending excavation E. Typically, the fluid distribution pipe is positioned longitudinally near the transverse midpoint of the excavation (i.e., near the 180° line in FIG. 12).

Figure 13:
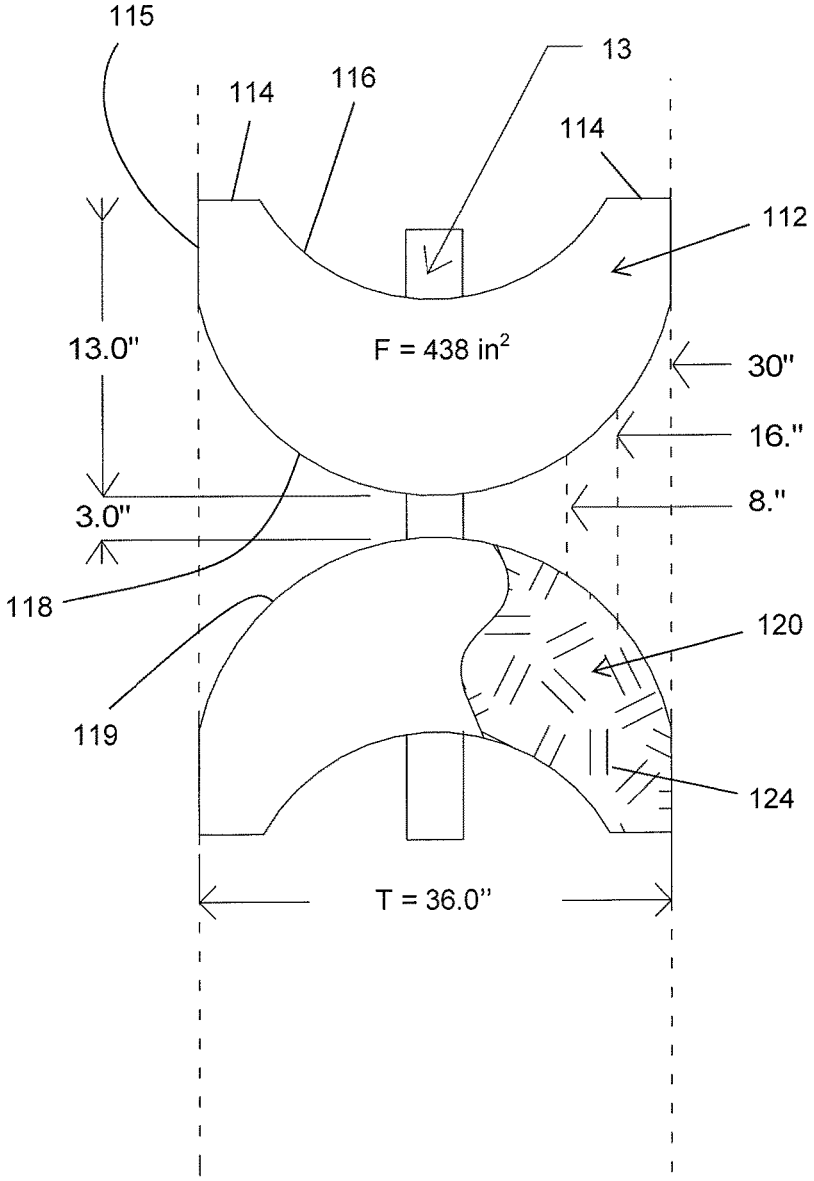
FIG. 13 is a top plan view of an embodiment of the disclosed drainage unit.

FIGS. 13-15B show plan views of several other embodiments of the disclosed drainage unit with arced modules, identifying certain exemplary dimensions. For example, FIG. 13 shows a unit with adjacent modules arced in opposite longitudinal directions. In this embodiment, the modules 112 and 120 extend longitudinally approximately 13 inches; the transverse thickness of each module is approximately 36 inches; the spacing between the front module rear face 118 and top and second module front face 117 is approximately 3 inches at the closest position (in FIG. 13, with the respective apexes substantially transversely aligned); and the area of the bottom footprint F of each module is approximately 438 square inches. As shown, this embodiment of the drainage unit has modules that have a substantially flat portion 115 intermediate the front edge surfaces 114 and the rear arced surface 118.

Figure 14:
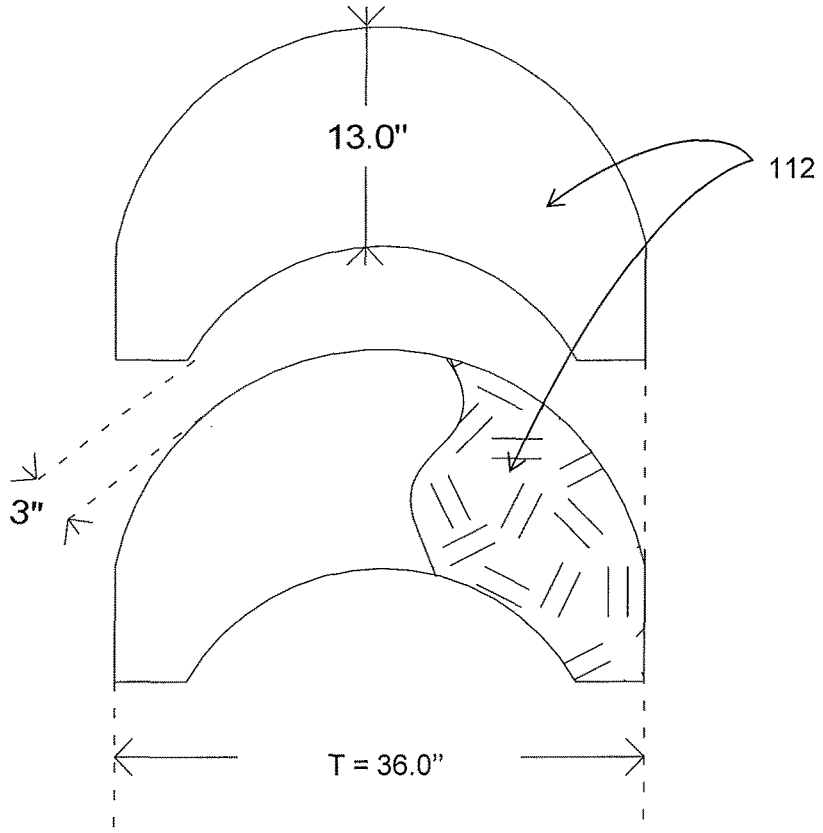
FIG. 14 is a top plan view of another embodiment of arced channels for use in the disclosed drainage units.

FIG. 14 shows another embodiment of the drainage unit with modules 112 of the same dimensions as FIG. 13, but aligned arcing in the same direction. As shown, the modules are spaced approximately 3 inches apart at their closest position.

Figure 15A:
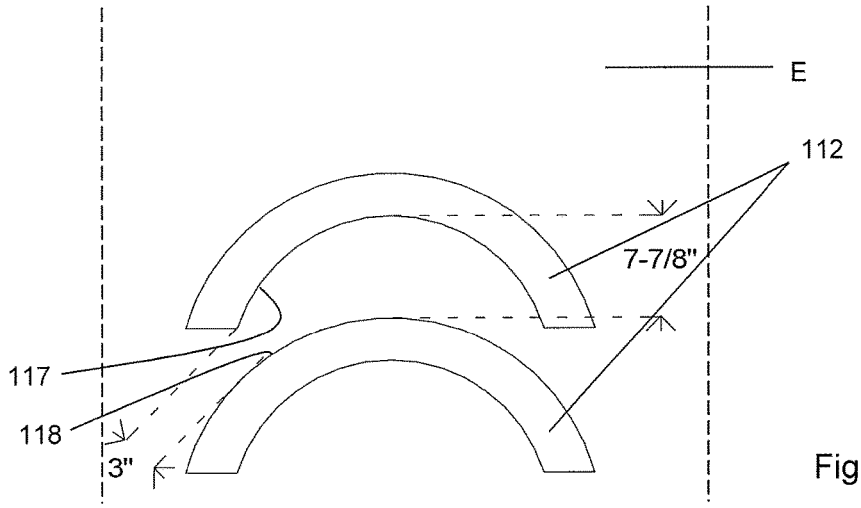
FIGS. 15A and 15B are top plan views of additional embodiments of arced channels for use in the disclosed drainage units.
Figure 15B:
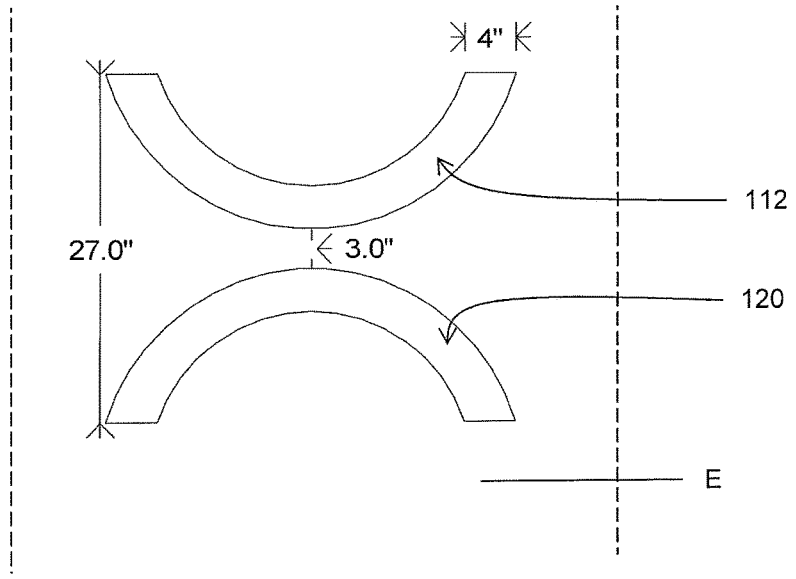

FIGS. 15A and 15B show additional embodiments of the drainage unit with arced modules 112 and 120 in an excavation E (with support pipe 13 and/or drainage conduit removed from clarity). As shown in FIG. 15A, the unit with modules arced in the same longitudinal direction includes approximately 3 inches of spacing between the adjacent module surfaces 117 and 118 at their closest position, but due to the arced contour, the spacing extends to approximately 7⅞ inches at their furthest position (at approximately the transverse midpoint). In the embodiment of FIG. 15B, the modules 112 and 120 are spaced from each other approximately 3 inches at the closest position (near the transverse midpoint), whereas due to the opposite relative direction of the arced contours, the spacing extends to approximately 27 inches (at the lateral edges).

A subsoil drainage and fluid absorption system is formed by placing one or more modular units 10, 10' or 100 in an excavation with the respective bottom faces downward usually abutting the excavation floor acting as a base, followed by backfilling the excavation with soil or another aggregate or suitable porous media so that the outer filtration surfaces of the modules are in contact with the backfill. Each module defines a channel between the respective front, rear, top and bottom faces for receipt of drainage fluid flow from the support pipe itself or a secondary conduit, for example a conduit positioned above or on top of the top surface of the module. The channel may fill with drainage fluid that slowly infiltrates into the surrounding absorbent soil or similar material, the rate of which is improved with increased surface area of the outer filtration fabric surfaces interfacing with the external environment.

A typical installation of the disclosed treatment system includes the sequential steps of:

1. Preparing an excavation, usually in a soil environment. The excavation should be sized and shaped to receive a modular unit. Of course, the size and configuration of the modular unit can also be varied as necessary to accommodate an excavation or environment.
2. Modular drainage units, including at least a plurality of modules and a support or fluid conduit pipe are placed within the excavation. Units can be assembled within the excavation or prior to placement therein. Adjacent support pipe pieces may be connected via appropriate connector and/or adhesive, depending on regulatory requirements if any. As indicated above, the plan layout of the modular system can be specified and configured as necessary for the particular environment with use of appropriate connectors.
3. In some embodiments, a fluid permeable fabric overcover may be employed, typically laid over the modular unit to improve subsoil breathability of the system.
4. The excavation is backfilled by hand shoveling or sloughing clean backfill material along the sides, between adjacent spaced modules and the top of the modular units. Backfill material can be clean and porous fill material, such as native soil, pearlite, septic fill, preferably devoid of large rocks. Appropriate seed may be laid over the excavated areas to protect against erosion and improve aesthetics.

As discussed, all of the embodiments of the drainage unit with flared or arced channels may have a fluid-permeable geotextile fabric wrapping around the front and rear faces, top and bottom faces, and/or side faces of the support module. The bottoms may be wrapped or may be left uncovered to contact the excavation floor and facilitate fluid transfer to the soil. The fabric can be sewn into a formed cover and fitted over the support module. The cover, or separate fabric sections, can also be fastened to the support module by any other suitable method, for example by adhesive bonding, heat welding, stapling or banding.

The disclosed modules (12, 12' and 112) can optionally include additional layer(s) of fluid permeable geotextile fabric positioned between the front faces and rear faces to aid fluid flow control and filtration within the channels. The modular system disclosed herein is versatile and adaptable as needed to satisfy different fluid flow rates and source locations, as well as different drainage system regulatory requirements or ordinances.

The exemplified modular units are general linear, traversing at least part of an excavation longitudinally with the support pipe, which is a non-limiting characteristic. In other embodiments the support pipes may be connected with angle fittings to provide a nonlinear subsoil fluid absorption system comprising multiple modular units.

The disclosed flared and arced modular units provide significantly more surface contact area between the surfaces of individual modules and the surrounding media environment per linear foot of land compared to known systems.

The disclosed modules (12, 12' and 112) are all generally self-supporting and self-contained, and comprise generally non-absorbent materials, while allowing fluid flow into the surrounding environment (backfill). As shown in the Figures, individual modules (12, 12' and 112) are typically positioned spaced apart from each other along a length of a longitudinal support pipe 13 within an excavation. The interior of the modules may be fluidly connected to each other via the support pipe (via apertures in the support pipe). Additional embodiments exist without the support pipe 13 providing a fluid path between module interior areas. For example, a fluid conduit can be positioned above the modules configured to deliver fluid to the modular system proximate the top edge of the modules, while the support pipe is employed to physically connect spaced apart modules. Still, further embodiments can include one or more fluid conduits positioned within a support pipe for delivering fluid to the modular system. Appropriate fluid conduits can be rigid (i.e., PVC pipe) or a flexible tubing. Flexible tube conduits can also be employed to deliver fluid to or from a module in virtually any direction, thereby improving versatility of the modular drainage system.

The distance that modules are separated from each other can be varied as required for particular objectives or conditions. Spacing between respective modules does not have to be uniform along the length of the support pipe, thus further improving the versatility of the drainage system. The spatial distance between adjacent edges of the module faces is typically 1.5 inches or more at the closest position, and more preferably approximately 3-12 inches. As shown in FIG. 2 for example, the flared modules 12' are spaced longitudinally along the support pipe with the upper edges of successive modules approximately 8 inches apart and the bottom edges abutting. Distance between adjacent module faces can be altered based on environmental conditions, such the type and/or density of media used to backfill the excavation and spaced area between modules. Similarly, width W, height H and transverse thickness T of individual modules can be varied.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A fluid drainage unit for installation in a ground excavation, comprising:

a first channel extending transversely and a second channel extending transversely, the first channel longitudinally spaced from the second channel along the excavation, the first and second channels being concavely arced relative to each other in the same longitudinal direction, the first channel defined between a front face extending between a top and bottom edge and being arced concavely in the longitudinal direction between a left edge and a right edge and a rear face extending between a top and bottom edge and being arced concavely in the same longitudinal direction relative to the first channel front face between a left edge and a right edge, the front and rear faces of the first channel extending substantially the same distance from their respective top to bottom edges, the left edges of the front and rear faces defining a left face therebetween and the right edges of the front and rear faces defining a right face therebetween, and the rear face defining a first filtration surface;

the second channel defined between a front face that is longitudinally spaced from the first channel rear face and that defines a second filtration surface, and a second channel rear face, both the second channel front face and second channel rear face extending from respective top to respective bottom edges and being arced between respective right and left edges with the respective second channel left edges defining a left face therebetween and the respective second channel right edges defining a right face therebetween, the second channel front face and the second channel rear face being concave in the same longitudinal direction; wherein the first channel right face is longitudinally spaced from the second channel right face and the first channel left face is longitudinally spaced from the second channel left face without a filtration surface positioned longitudinally between the second channel right face and the first channel, and without a filtration surface positioned longitudinally between the second channel left face and the first channel;

the first channel and second channel are fluidly connected to one another; and the arc of the first channel extends between its left face and right face and extends along an angle of between approximately 60 degrees and 270 degrees, and the arc of the second channel extends between its left face and right face and extends along an angle of between approximately 60 degrees and 270 degrees.

2. The fluid drainage unit of claim 1, wherein the transverse thickness T between the first channel rear face right edge and the first channel rear face left edge is between approximately 12 and 64 inches.

3. The fluid drainage unit of claim 2, wherein the transverse thickness T between the second channel rear face right edge and the second channel rear face left edge is between approximately 12 and 64 inches.

4. The fluid drainage unit of claim 1, wherein the longitudinal distance between the first channel front face and first channel rear face is not constant along a plane that extends substantially parallel to the longitudinal direction and between the top edge and the bottom edge of the front face and rear face.

5. The fluid drainage unit of claim 1, wherein the bottom edges of the front and rear faces of the first channel and bottom edges of the left and right faces of the first channel define a first channel footprint and the bottom edges of the front and rear faces of the second channel and bottom edges of the left and right faces of the second channel define a second channel footprint, and each of the first channel footprint and the second channel footprint has an area within the range of 24-3840 square inches.

6. The fluid drainage unit of claim 1, wherein the arced shape of the first channel rear face defines an apex and the left and right edges of the second channel front face are equidistant from the apex of the arc of the first channel rear face.

7. The fluid drainage unit of claim 6, wherein the distance between the first channel rear face and the second channel front face is 1.5 inches or greater.

8. The fluid drainage unit of claim 7, wherein the distance between the first channel rear face and the second channel front face is within the range of 3-12 inches.

9. The fluid drainage unit of claim 1, wherein the first and second channels are fluidly connected via a longitudinal pipe extending through the first channel rear face and second channel front face.

10. The fluid drainage unit of claim 9, wherein the longitudinal pipe extends through both the first channel and second channel and includes at least one aperture aligned with each channel.

11. The fluid drainage unit of claim 1, wherein the first channel has a width W coinciding with the distance between its front and rear faces, and the bottom edges of the front and rear faces of the first channel and bottom edges of the left and right faces of the first channel define a first channel footprint having an area F, and the transverse thickness T between the first channel rear face left edge and the first channel rear face right edge is reduced relative to a channel with the same width W and same channel footprint area F and substantially planar front and rear surfaces extending substantially perpendicular to the longitudinal direction within the range of between approximately 10-70%.

12. The fluid drainage unit of claim 1, wherein the spacing between the first channel rear face and second channel front face is not constant along a plane that extends substantially parallel to the longitudinal direction and between the respective top edges of the first channel rear face and second channel front face and between the respective bottom edges of the first channel rear face and the second channel front face.

13. The fluid drainage unit of claim 1, wherein the angle of arc of the first channel and the angle of arc of the second channel are approximately the same.

14. The fluid drainage unit of claim 1, wherein the arc of the first channel defines a first apex and the arc of the second channel defines a second apex, the first apex and second apex being aligned with one another along a longitudinal axis.

15. The fluid drainage unit of claim 1, wherein the front, rear, left and right faces of the first channel each comprises a filtration surface, the front, rear, left and right faces of the second channel each comprises a filtration surface, and there is no filtration surface positioned longitudinally between the first channel and second channel.

16. The fluid drainage unit of claim 1, wherein each channel is defined by a module comprising at least one piece of supportive polymeric core material.

17. A fluid drainage unit for installation in a ground excavation, comprising:

a longitudinally extending conduit having a plurality of openings for delivery of fluid, the conduit defining a longitudinal axis;

a first channel with a top surface and a bottom surface extending in an arcuate concave direction between a right face and a left face, the right face having an outer right edge and being positioned on one side of the longitudinal axis and the left face having an outer left edge and being positioned on the opposite side of the longitudinal axis, the first channel top surface and first channel bottom surface each defining a filtration surface;

a second channel with a top surface and a bottom surface extending in an arcuate concave direction between a right face and a left face, the second channel right face having an outer right edge and being positioned on one side of the longitudinal axis and the second channel left face having an outer left edge and being positioned on the opposite side of the longitudinal axis, the second channel top surface and second channel bottom surface each defining a filtration surface, the second channel being concave in the same longitudinal direction relative to the first channel; wherein the first channel is spaced longitudinally from the second channel without a filtration surface positioned longitudinally between the first channel and the second channel, the openings in the fluid delivery conduit align longitudinally with the first channel and second channel to provide a fluid connection between the first channel and second channel, and the first channel has a width W coinciding with a width of the right face and a width of the left face of the first channel, and the bottom surface of the first channel defines a first channel footprint having an area F, and the transverse thickness T between the first channel outer left edge and the first channel outer right edge is reduced relative to a channel with the same width W and same channel footprint area F and substantially planar front and rear surfaces extending substantially perpendicular to the longitudinal direction within the range of between approximately 10-70%.

18. The fluid drainage unit of claim 17, wherein the longitudinally extending conduit is a rigid pipe that extends through the first channel and second channel intermediate the respective top and bottom surfaces.

19. The fluid drainage unit of claim 17, wherein the first channel includes a front face extending from the first channel right face to the first channel left face and being spaced from a rear face extending from the first channel right face to the first channel left face, and each of the first channel front face, first channel rear face, first channel right face and first channel left face defines a filtration surface.

20. The fluid drainage unit of claim 19, wherein each of the filtration surfaces defined by the first channel front face, first channel rear face, first channel right face, first channel left face, first channel bottom surface and first channel top surface is formed of a singular unit of wrapped filtration material.

* * * * *